US007165938B2

(12) United States Patent
Lee et al.

(10) Patent No.: US 7,165,938 B2
(45) Date of Patent: Jan. 23, 2007

(54) FAN DEVICE FOR REMOVING HEAT FROM HEAT SOURCES

(76) Inventors: Sen-Yung Lee, 9F, No. 84, Section 3, Chang-Rong Road, Tainan City (TW); Shueei-Muh Lin, No. 17, Lane 99, Ming-Shin Road, Tainan City (TW); Hsin-Mao Hsieh, No. 6, East Section, Industrial Sixth Road, Pin-Tong City (TW)

( * ) Notice: Subject to any disclaimer, the term of this patent is extended or adjusted under 35 U.S.C. 154(b) by 232 days.

(21) Appl. No.: 10/943,887

(22) Filed: Sep. 20, 2004

(65) Prior Publication Data

US 2006/0073043 A1 Apr. 6, 2006

(51) Int. Cl.
*F04D 29/30* (2006.01)

(52) U.S. Cl. ..... 415/206; 416/183; 416/186 R; 416/203; 416/210 R

(58) Field of Classification Search ..... 415/206, 415/228; 416/175, 182, 183, 203, 210 R, 416/211, 186 R
See application file for complete search history.

(56) References Cited

U.S. PATENT DOCUMENTS 6,873,069 B1 * 3/2005 Odagiri et al. ..... 310/64
6,964,556 B2 * 11/2005 Chiu et al. ..... 415/205
2004/0258527 A1 * 12/2004 Kaneko et al. ..... 416/182

* cited by examiner

*Primary Examiner*—Ninh H. Nguyen
(74) *Attorney, Agent, or Firm*—Rosenberg , Klein & Lee

(57) ABSTRACT

A fan device includes a casing having a recess defined in a first side thereof so as to receive a fan unit therein, and a hole defined through a second side of the casing. An outlet is defined in a side of the casing. The fan unit includes a first ring and a motor is located at a center of the first ring. A plurality of inner blades extend from an inner periphery of the first ring and a plurality of outer blades extend from an outer periphery and an underside of the first ring. The inner plates are connected to the motor. The fan device sucks air from both sides of the casing and the air flows out from the outlet smoothly.

5 Claims, 10 Drawing Sheets

FAN DEVICE FOR REMOVING HEAT FROM HEAT SOURCES

FIELD OF THE INVENTION

The present invention relates to a fan device including at least one ring and inner blades and outer blades extend form an inner periphery and an outer periphery of the at least one ring.

BACKGROUND OF THE INVENTION

A conventional fan device for removing heat from a hear source such as a CPU in a computer is disclosed in FIG. 1 and generally includes blades on one side of the base and the fan device can only suck air from one side. Another fan device is disclosed in FIGS. 2 and 3, and includes blades on two sides of the base and the fan device may suck air from two sides so as to increase the efficiency for removing heat. Nevertheless, the air sucked from the two sides hit the base form which the blades extend such that noise and shaking become main concerns of the fan device. The base separates the air flows sucked form two sides and the speed, volume and pressure on the two sides of the fan device are different thereby generating turbulence at the outlet of the fan device. Besides, the blades are straight which is not benefit for the air flows.

The present invention intends to provide a fan device that includes at least one ring and a plurality of inner blades and outer plates extend from the inner periphery and the outer periphery of the at least one ring.

SUMMARY OF THE INVENTION

The present invention relates to a fan device that comprises a casing having a recess defined in a first side thereof so as to receive a fan unit therein, and a hole is defined through a second side of the casing. An outlet is defined in a side of the casing. The fan unit includes a first ring and a motor is located at a center of the first ring. A plurality of inner blades extend from an inner periphery of the first ring and a plurality of outer blades extend from an outer periphery and an underside of the first ring. The inner plates are connected to the motor.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
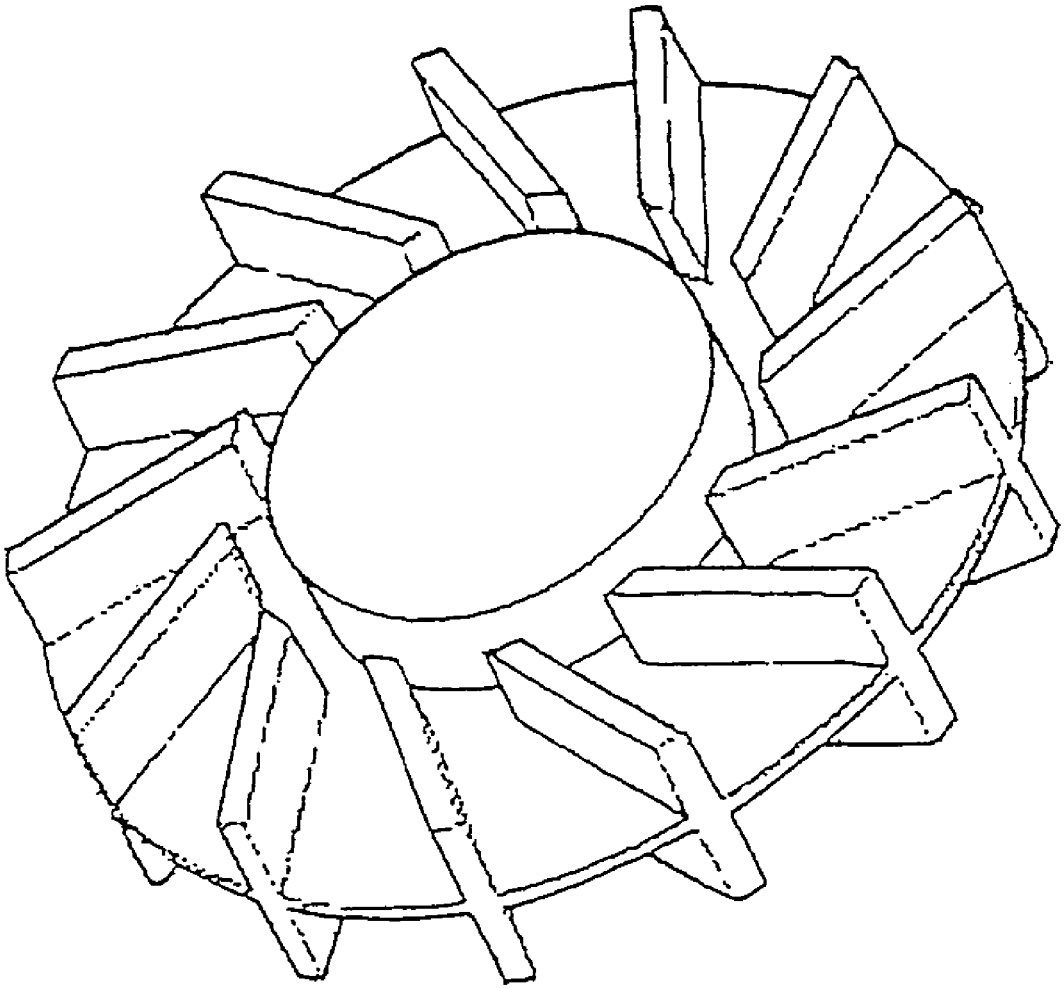
FIG. 1 PRIOR ART
FIG. 1 shows a conventional fan device.
Figure 2:
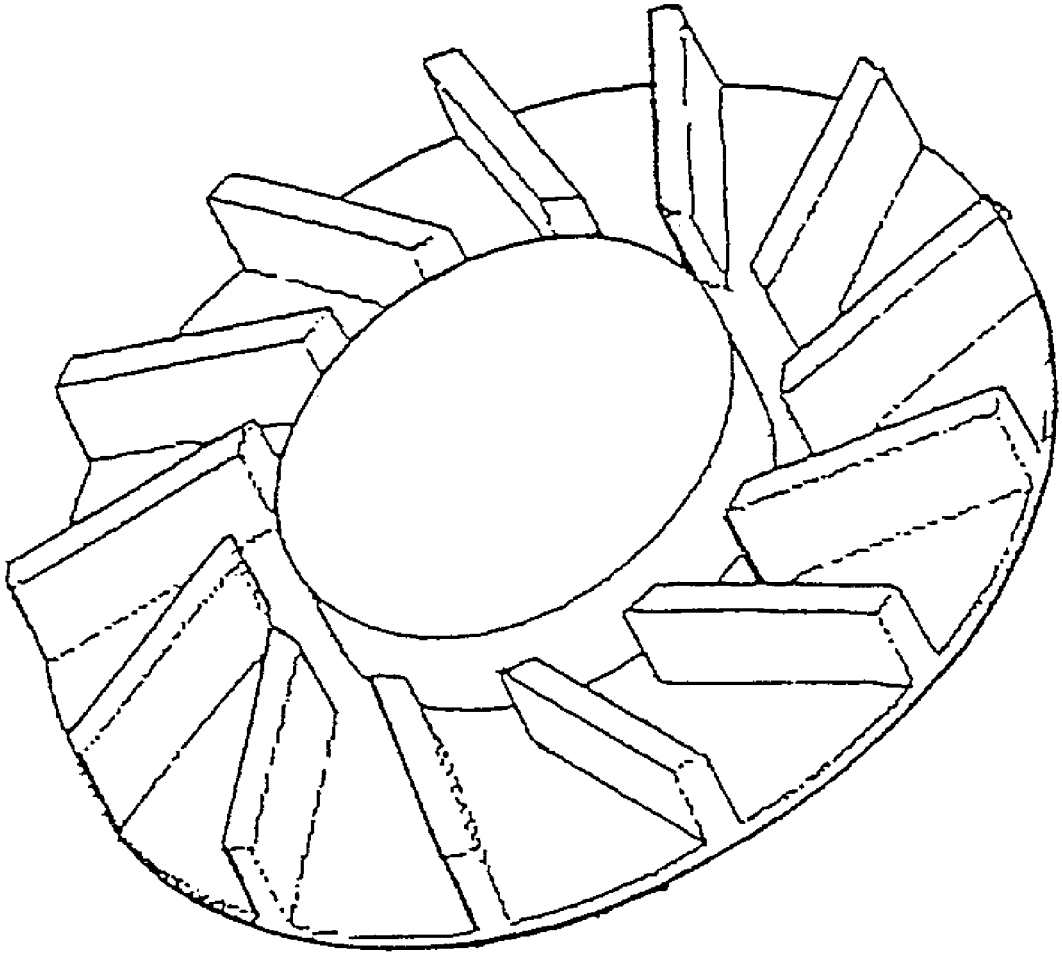
FIG. 2 PRIOR ART
FIG. 2 shows another conventional fan device.
Figure 3:
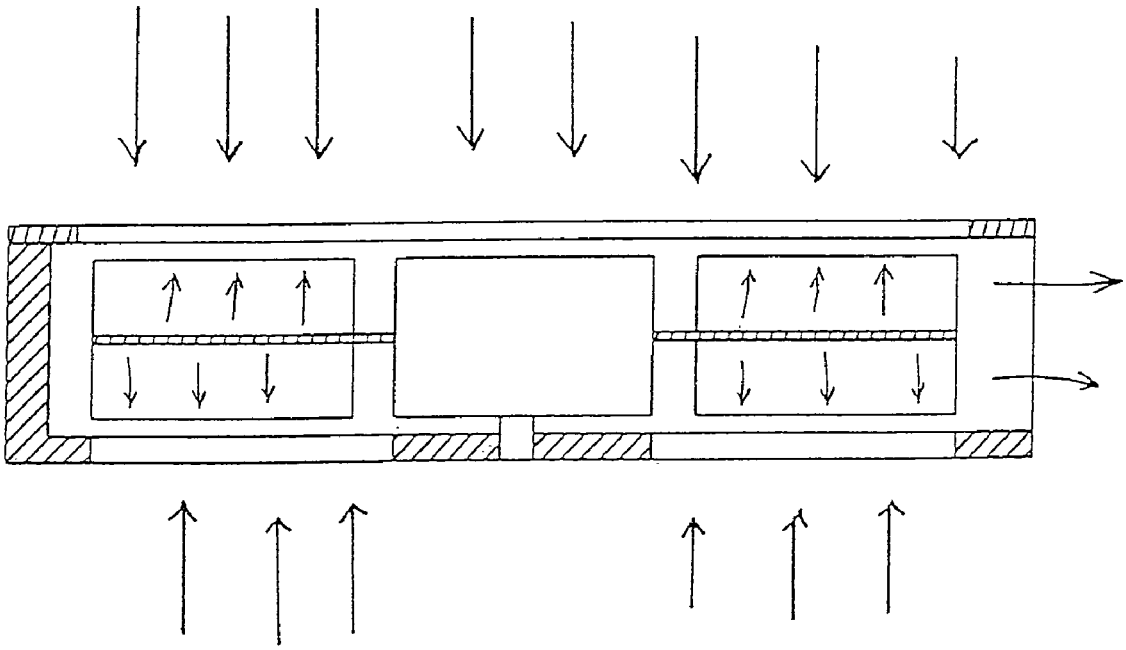
FIG. 3 PRIOR ART
FIG. 3 is a side cross sectional view to show the conventional fan device in FIG. 2.
Figure 4:
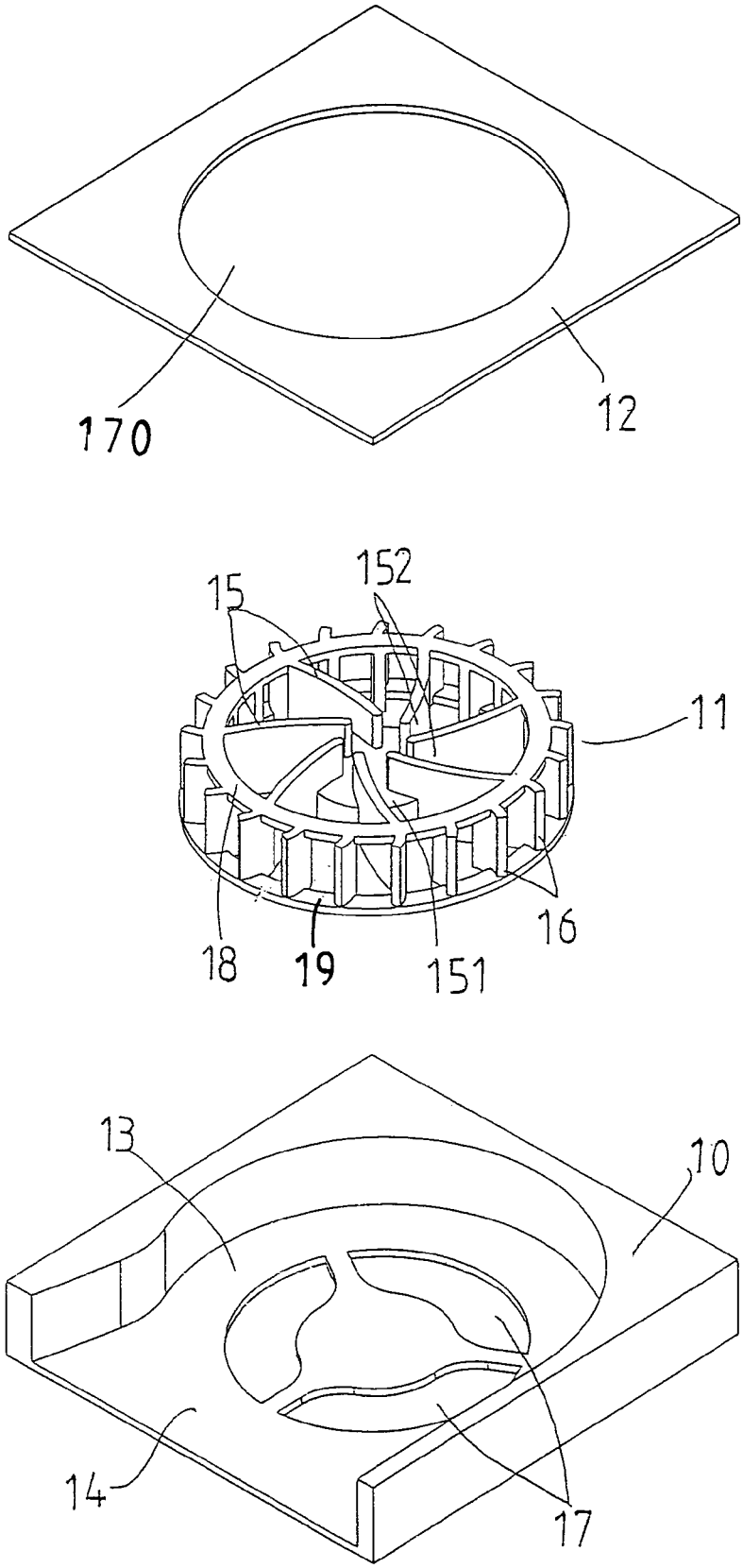
FIG. 4 is an exploded view to show the fan device of the present invention.
Figure 5:
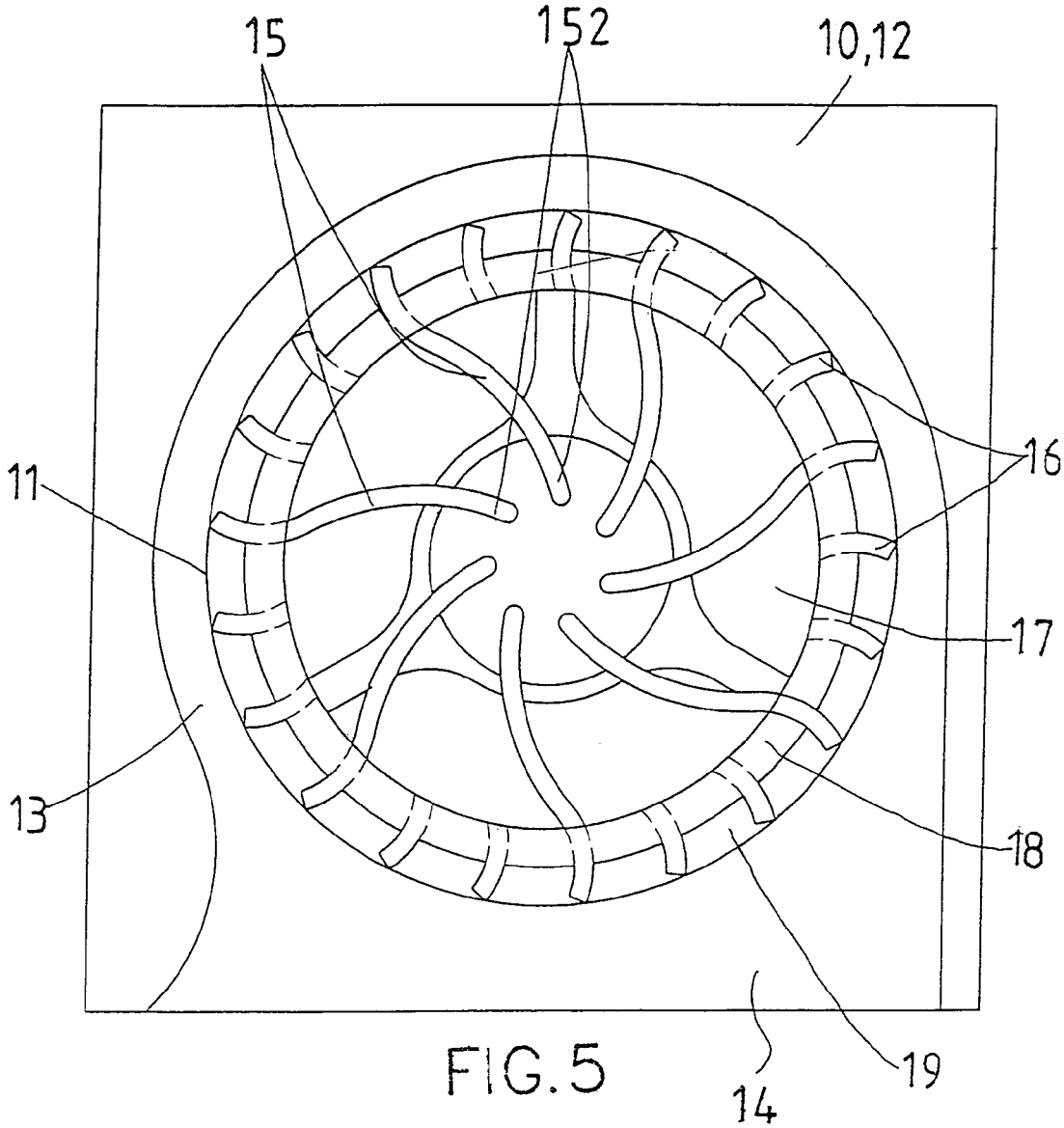
FIG. 5 is a top view of the fan device of the present invention.
Figure 6:
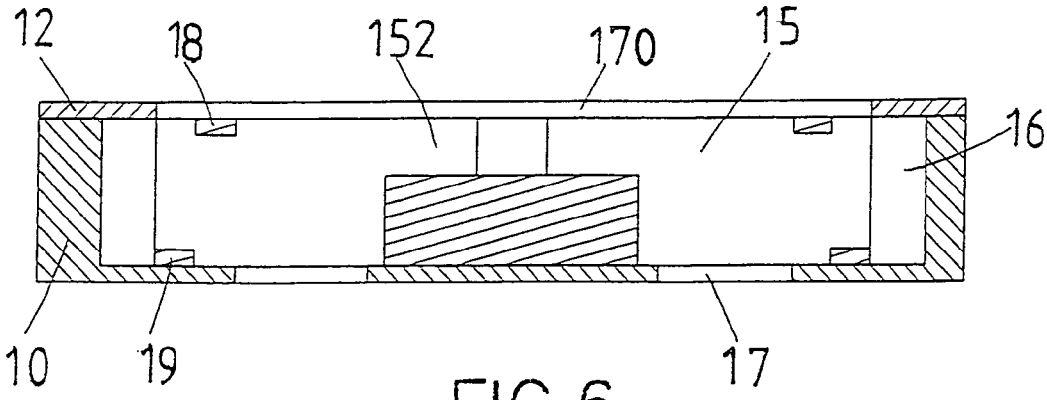
FIG. 6 is a cross sectional view of the fan device of the present invention.
Figure 7:
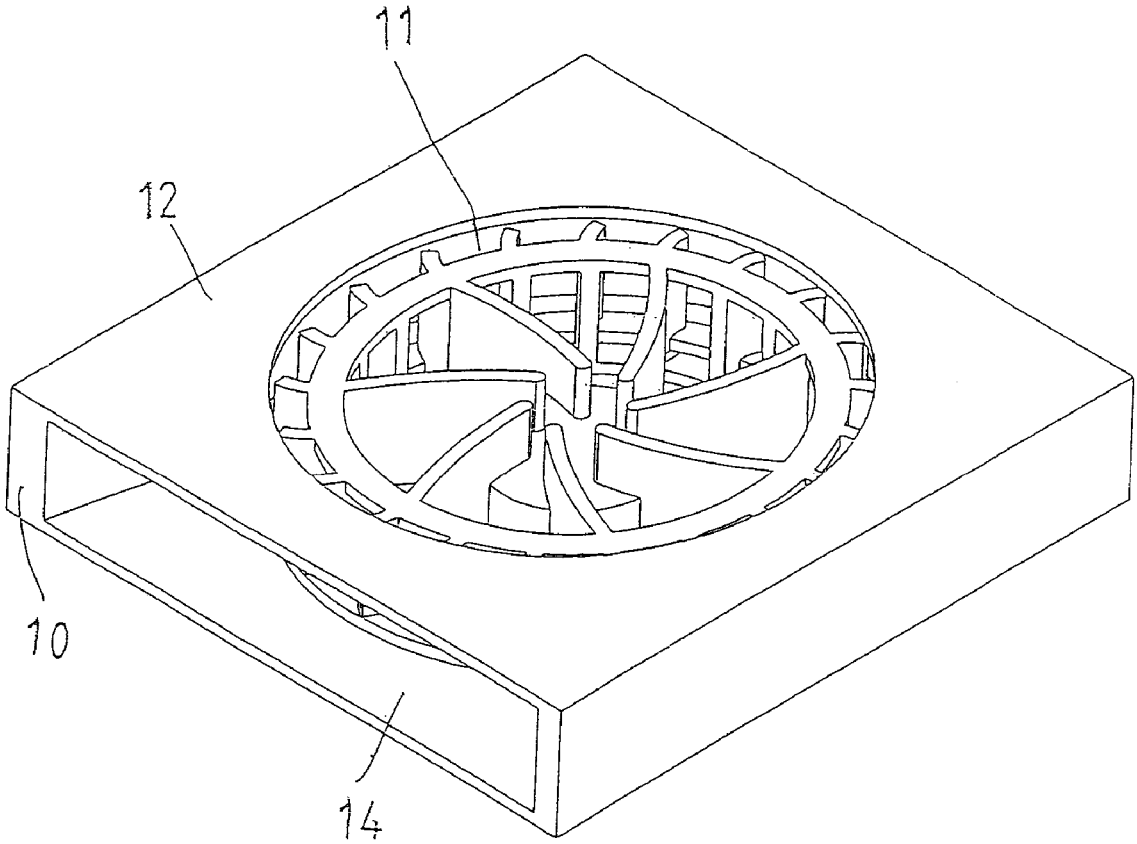
FIG. 7 is a perspective view of the fan device of the present invention.

Referring to FIGS. 4 to 7, the fan device 1 of the present invention comprises a casing 10 having a recess 13 defined in a first side thereof so as to receive a fan unit 11 therein, and three holes 7 are defined through a second side of the casing 10. An outlet 14 is defined in a side of the casing 10 and in communication with the recess 13.

The fan unit 11 includes a first ring 18, a second ring 19, and a motor 151 located at a center of the first and second rings 18 and 19. A plurality of curve inner blades 15 extend from the two respective inner peripheries of the first ring 18 and the second ring 19. The inner blades 15 each have an extension portion 152 which is connected on a top of the motor 151. A plurality of curve outer blades 16 extend from an outer periphery and an underside of the first ring 18. The first ring 18 is in flush with a top side of the inner and outer blades 15, 16, A lower side of each outer blades 16 are connected to a top of the second ring 19. A number of the inner blades 15 is less than a number of the outer blades 16. In other words, each of the inner blades 15 is connected to one of the outer blades 16 and some of the outer blades 16 are not connected to the inner blades 15. The connection of the inner blades 15 and the outer blades 16 form smooth curve blades. A diameter of the first ring 18 is different from that of the second ring 19. In this embodiment, the diameter of the first ring 18 is smaller than the diameter of the second ring 19. A cover 12 is connected to a top of the casing 10 and includes a hole 170 whose diameter is larger than the diameter of the fan device 11 so that the fan device 11 sucks air via the hole 170. Air is sucked from the underside of the fan device 11 via the holes 17. The curve blades 15, 16 efficiently suck air from both sides of the fan device 11 and send the air out from the outlet 14.

Figure 8:
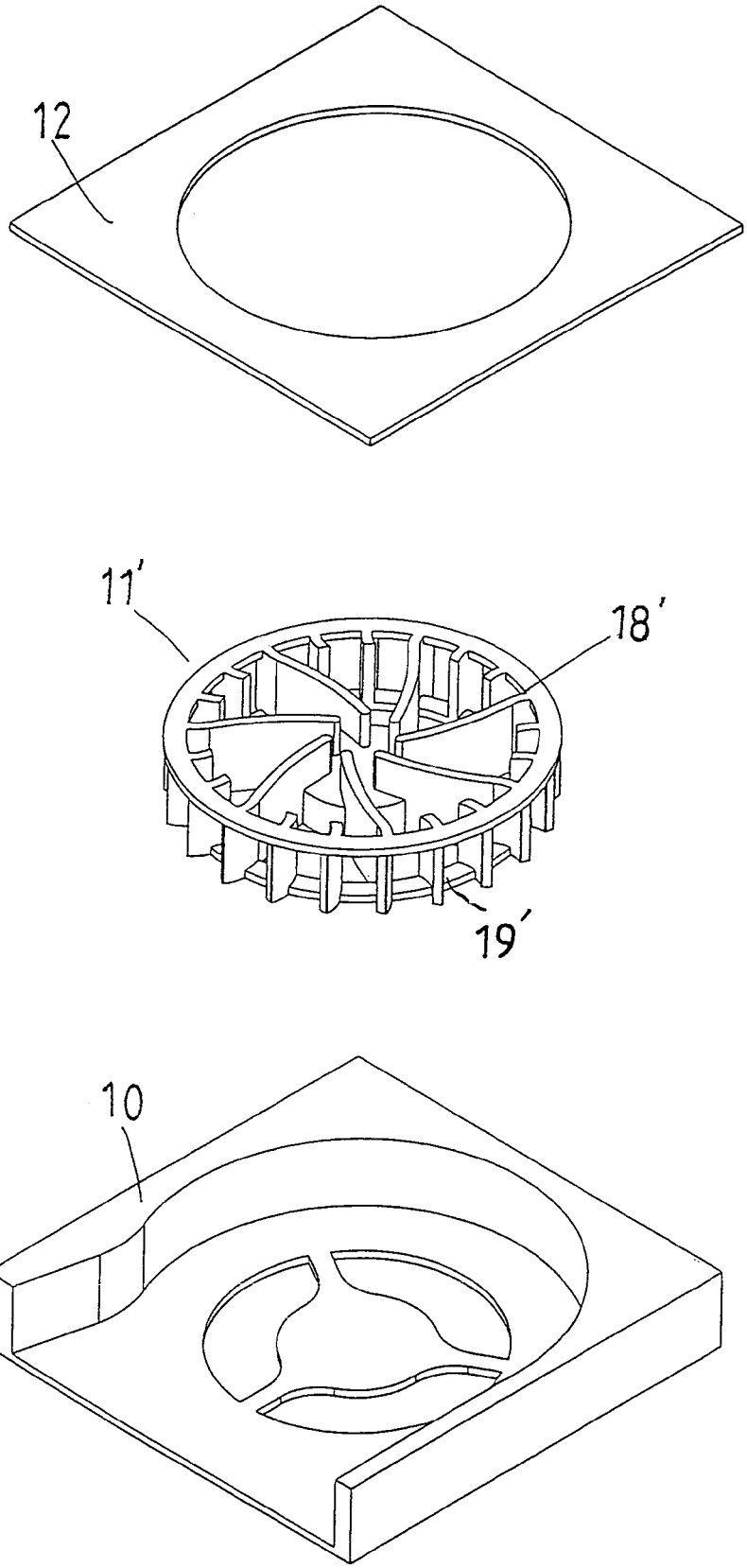
FIG. 8 is an exploded view to show another embodiment of the fan device of the present invention.
Figure 9:
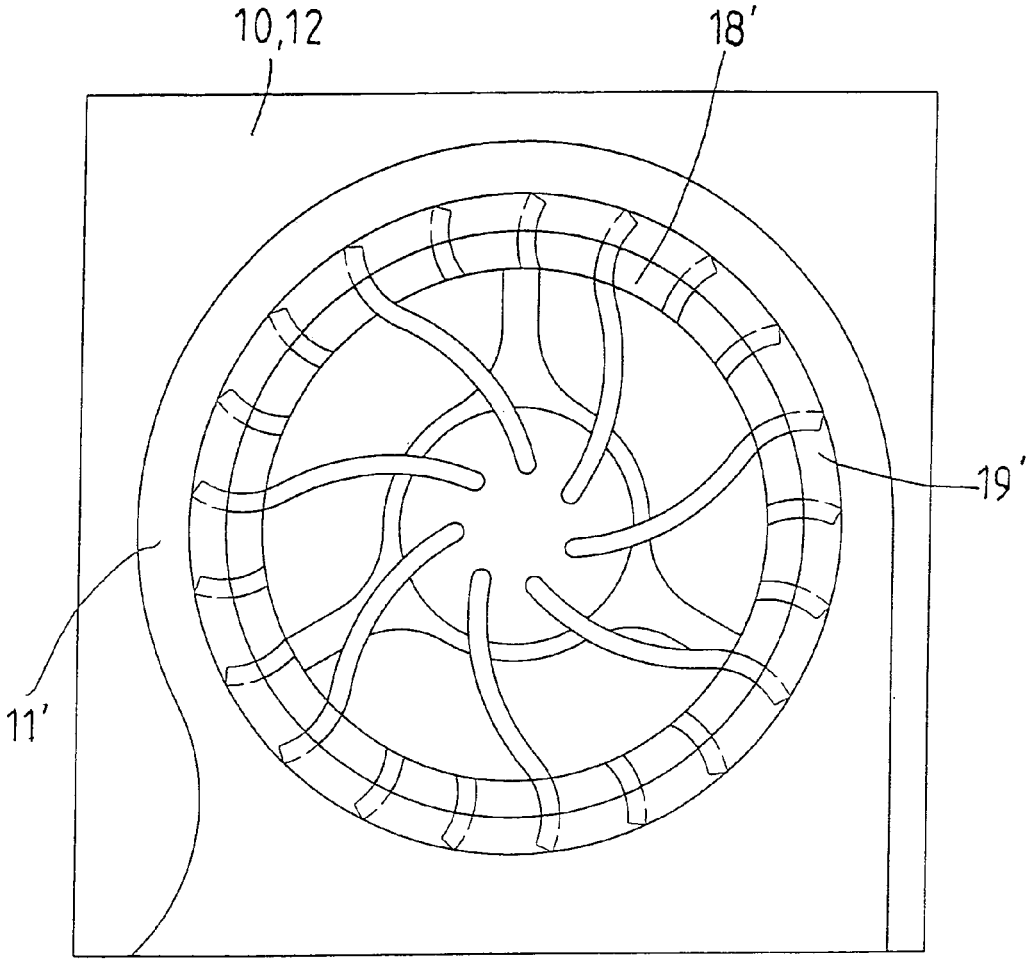
FIG. 9 is a top view of the fan device in FIG. 8.
Figure 10:
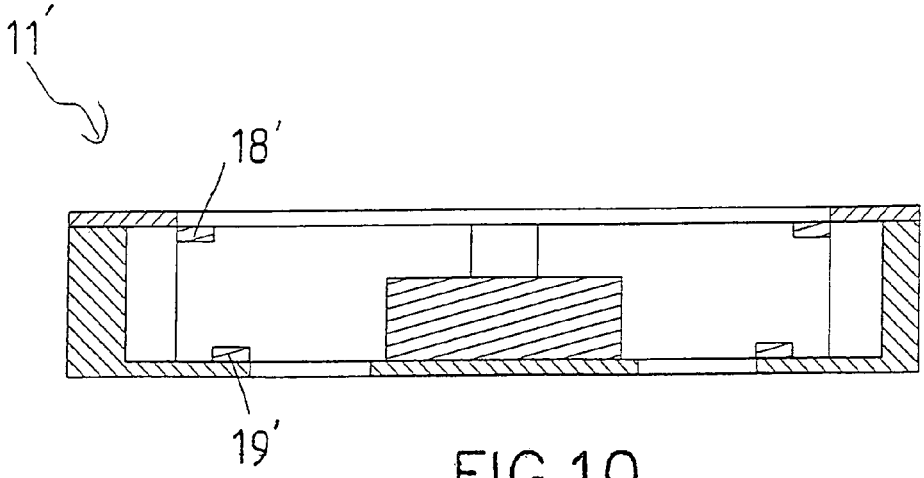
FIG. 10 is a cross sectional view of the fan device in FIG. 8.
Figure 11:
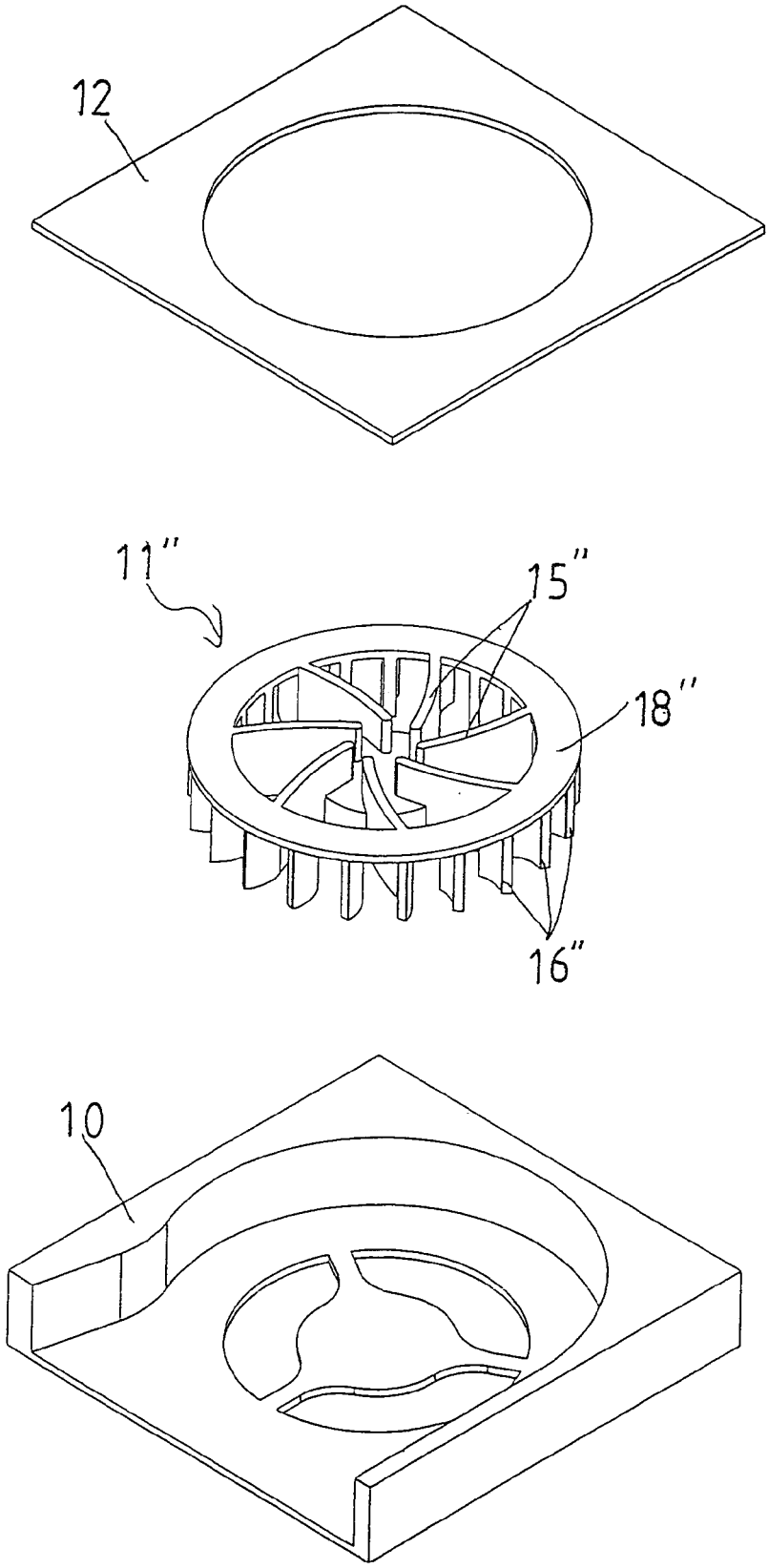
FIG. 11 is an exploded view to show yet another embodiment of the fan device of the present invention.
Figure 12:
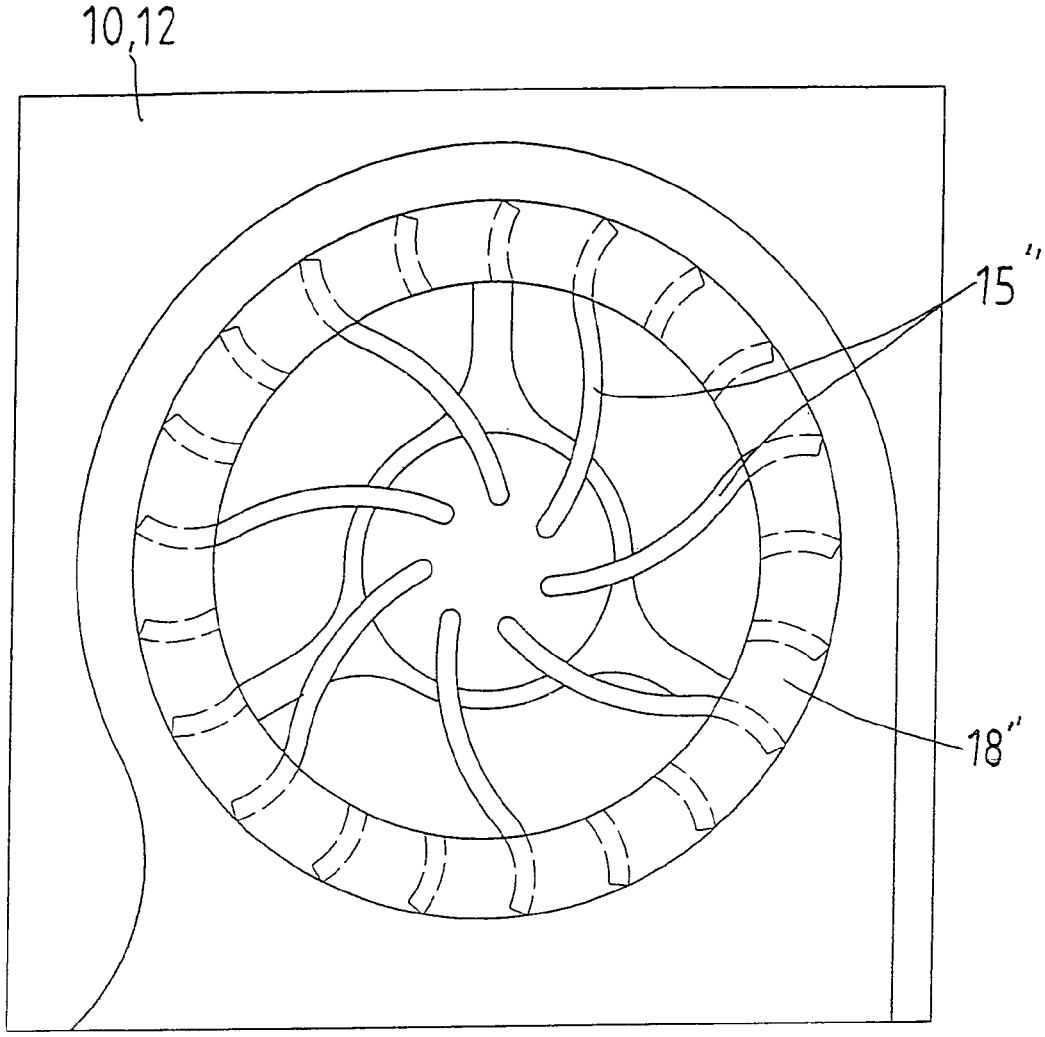
FIG. 12 is a top view of the fan device in FIG. 11.
Figure 13:
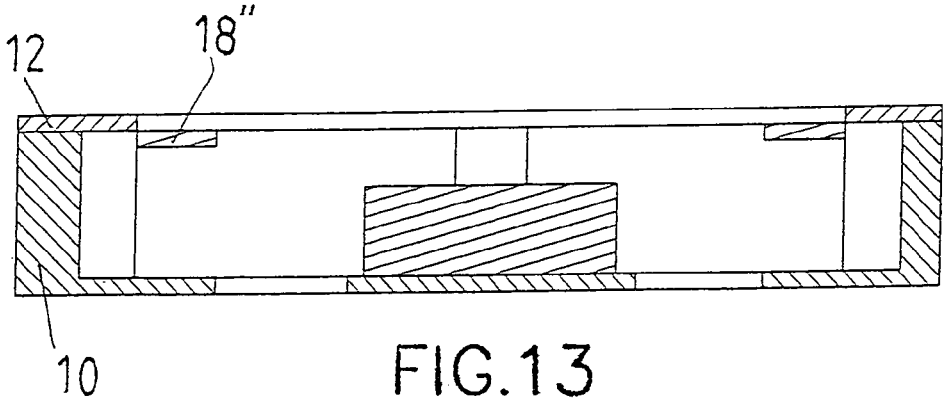
FIG. 13 is a cross sectional view of the fan device in FIG. 11.

FIGS. 8 to 10 show another embodiment of the fan device wherein the diameter of the first ring 18' of the fan unit 11' is larger than that of the second ring 19'. FIGS. 11 to 13 show yet another embodiment of the fan device wherein the fan unit 11" includes only the first ring 18".

While we have shown and described the embodiment in accordance with the present invention, it should be clear to those skilled in the art that further embodiments may be made without departing from the scope of the present invention.

What is claimed is:

1. A fan device comprising:

a casing having a recess defined in a first side thereof and a hole defined through a second side of the casing, an outlet defined in a side of the casing, and;

a fan unit received in the recess and including a first ring, a motor located at a center of the first ring, a plurality of inner blades extending from an inner periphery of the first ring and a plurality of outer blades extending from an outer periphery and an underside of the first ring, the inner blades connected to the motor, the first ring being flush with a top side of the inner and outer blades, a second ring connected to a lower side of the outer blades.

2. The fan device as claimed in claim 1, wherein the inner blades each have an extension portion connected on a top of the motor.

3. The fan device as claimed in claim 1, wherein a number of the inner blades is less than a number of the outer blades.

4. The fan device as claimed in claim 1, wherein a diameter of the first ring is different from that of the second ring.

5. The fan device as claimed in claim 1, wherein each of the inner blades is connected to one of the outer blades.

* * * * *